United States Patent [19]

Faltin

[11] Patent Number: 4,792,077

[45] Date of Patent: Dec. 20, 1988

[54] APPARATUS FOR STAPLING AND CREASING PAPER ARTICLES IN TRANSIT

[75] Inventor: Hans G. Faltin, York, Pa.

[73] Assignee: Custom-Bilt Machinery, Inc., York, Pa.

[21] Appl. No.: 42,747

[22] Filed: Apr. 27, 1987

[51] Int. Cl.[4] ..... B42C 1/00

[52] U.S. Cl. ..... 227/81; 227/88; 227/89; 227/92; 270/37

[58] Field of Search ..... 227/81, 82, 85, 87, 227/88, 89, 92; 270/37, 53

[56] References Cited

U.S. PATENT DOCUMENTS

| | | | |
|---|---|---|---|
| 510,845 | 12/1893 | Crowell | 227/81 |
| 1,054,043 | 2/1913 | Sheldon | 227/85 X |
| 3,653,570 | 4/1972 | Alsop | 227/81 |
| 4,204,626 | 5/1980 | Kutzner et al. | 227/87 X |
| 4,315,588 | 2/1982 | Faltin | 227/81 |

*Primary Examiner*—Paul A. Bell

*Attorney, Agent, or Firm*—Laurence R. Brown; Alfred J. Mangels

[57] ABSTRACT

A chain link type stapler operates in transit at about 45,000 items per minute to staple and crease printed paper products. Only two link chains are required and they have a common contiguous path for receiving and clasping the paper products for transit while being stapled by means of mating, stapler and anvil links. The stapler link operates to receive wire lengths, form staples therefrom, insert and clinch the staples over a cyclic path of the chain. This is achievable by means of a reciprocating wire clip assembly journalled in an internal cavity of the stapler link. Reciprocation is programmed by a cam arm extending externally from the clip assembly and stapler link on which roller means is mounted to ride in a cam track about the chain travel path. Thus, the reciprocating mechanism receives a length of wire, locks it in place, draws it internally into a die set formed by the reciprocating clip and link cavity to form the staple, ejects it into the paper product, clenches it, and releases the lock to let the staple drop out if a paper product is not in place.

29 Claims, 6 Drawing Sheets

APPARATUS FOR STAPLING AND CREASING PAPER ARTICLES IN TRANSIT

TECHNICAL FIELD

This invention relates to stapling and, if required, creasing of printed paper articles such as booklets or catalogs while moving in transit at high speeds up to 45,000 items per hour, either on line or offline with a press. More particularly, it relates to feeding, cutting and transferring cut pieces of wire to dies for forming, inserting and clinching staples while moving along a paper article transit path at the paper transit speed, to thereby increase the time period for staple insertion without having to stop the product and/or a stitcher, thus greatly increasing operating speed.

BACKGROUND ART

I have proposed to use a continuously running chain link assembly to transport stapling dies alongside a paper signature moving at press speeds in U.S. Pat. No. 4,315,588, issued Feb. 16, 1982, for "High Speed On-Line Stitcher for Signatures and Webs". This equipment, in general, resolves the general problems of generally complex prior art reciprocating type staplers which require the papers to stop before stapling and/or require the stapling machine to reciprocate.

This invention improves the status of my aforesaid chain link transport type of stapling apparatus by reducing the complexity of the chain drive system and improving the reliability of transferring the wire to the staple forming and inserting mechanisms, which, in turn, are also simplified and improved.

BRIEF DISCLOSURE OF THE INVENTION

The primary staple forming and inserting mechanism of this invention is carried as a stapler link in a chain assembly which receives the paper article to be stapled between a common continguous transit path portion along two cyclically moving chains. Thus, the chains receive and transport the paper article so that the staple may be inserted along the transit path. The entire assembly includes two cyclically moving chains, and means for cutting a length of wire from a roll of wire and transferring it to a stapler link carried on one chain in which the staple is grasped, formed, and ejected into the paper article.

Thus, the stapler link constitutes a movable, wire handling mechanism which has a cam arm extending for actuating the internal mechanism as the link proceeds cyclically about the chain path. The internal mechanism reciprocates to extend a wire receiving and retaining clip-retainer assembly into which a predetermined length of straight wire from a roll is cut and transferred for retention and transit. This wire is pulled by the clip internally into the stapler link hollow body, which has a staple forming die operable to shape the staple as the clip-retainer pulls the wire inwardly.

The staple is then pushed outwardly to eject it into the paper article when the two chains are in the continguously located transit path and pulling the paper article through. The second chain assembly has a clinching anvil link mating with the stapler link. In the event no product is present, the staple is released by the stapler link at a position where it falls free to avoid jamming.

The stapler and clinching links and other chain links in the two chains form a mechanism for handling the paper article creased along the staple line. If required, this mechanism can crease the paper article as it is stapled. Several staples may be entered into each paper article at spacings established by the link separation distances.

Cam tracks disposed about the chain path serve to press the two chains together in the transit path for creasing and transport. Preferably for this purpose, each link is guided in a channel by a pair of rollers disposed on opposite sides of the links. This provides means for forcing the chain links together to grasp and transport paper articles through the transit path. A further cam track is provided for a similar roller cam arm for reciprocating the internal mechanism of the stapler link so that it cycles through the wire receiving, staple forming, staple ejecting and staple clinching modes of operation at the appropriate positions along the transit path. In one mode the link is retracted away from the continuous transit path relationship after the staple is clinched to prevent any paper damage.

The hollow body of the stapler link guides the reciprocating clip mechanism as moved by the aforesaid cam action. The clip is pivoted over a wire retaining matrix receptacle for alternatively holding and releasing the wire in place in the receptacle. To insert the wire length cut from a roll, the clip is simply pivoted by the wire to snap it into a detented position on the clip. Then a toggle arrangement permits the clip to travel inwardly to form the staple by bending the ends into mating die channels. However, the toggle upon moving outwardly releases the clip to drop or eject the staple, depending upon whether the paper article is in place. Then the clip is fully extended outside the cavity with the clip closed by spring action to permit the wire to be snapped into place for a repeat cycle as the stapler link travels about the track.

THE PREFERRED EMBODIMENT

Figure 1:
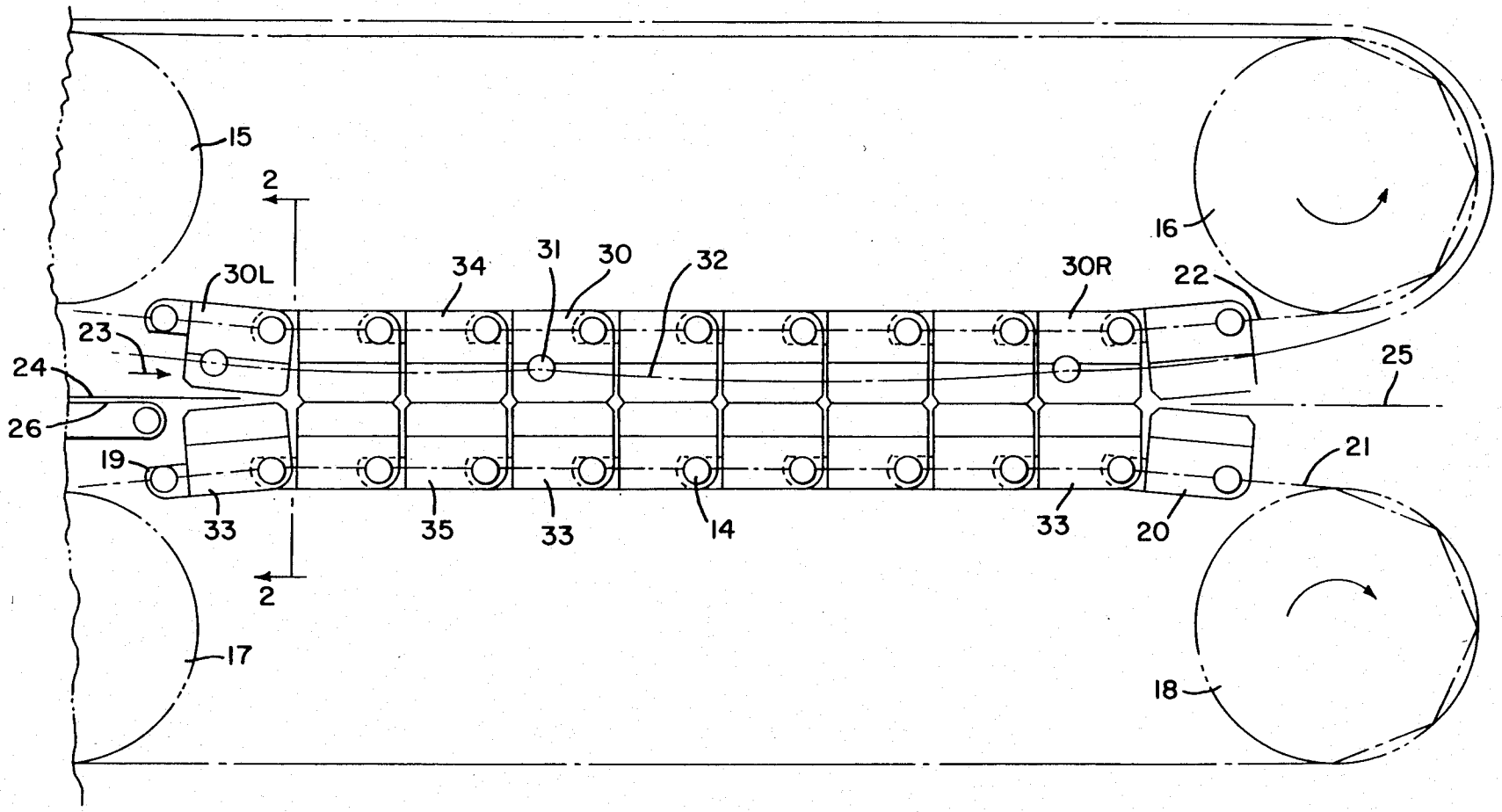
FIG. 1 is a side profile sketch of the two cyclically moving chains showing the position of the links which staple and crease paper articles along a common contiguous paper article transit path.

As seen in FIG. 1, two chains are cyclically driven about a path defined by the respective synchronously driven chain drive sprocket wheel sets 15, 16, and 17, 18 so that their paths are contiguous where the links of the two chains are shown coming together. Only a portion of the links are shown so that at each end the link configuration may be more prominent. Thus, a pivot pin 14 extends through a journal aperture located at centered projection 19 at one end and separate side panels 20 at the other end. As will be shown later, each pivot pin 14 terminates in opposed rollers extending outwardly from opposite sides of the links to engage cam tracks schematically represented as 21, 22, which define the cyclic travel path of the links.

It may thus be seen that in the direction of travel of arrow 23 and chain drive wheels 16, 18, an incoming signature 24 or like paper product that is to be stapled is transferred from incoming conveyor belt 26 and is grasped between the two sets of links in the respective chains as they contiguously meet. The paper products may be pre-creased, and the creases are aligned with the movement of the links. If not, it is creased in transit between the chain links. The staples are inserted and clinched along the contiguous pathway in transit as the paper products move at speeds up to about 45,000 per hour, and then they are discharged along exit path 25 onto a suitable conveyor for further transit.

Note that special links 30 comprise stapler links that have a further set of rollers 31 engaging a further cam track 32. The spacing of stapler links 30 can be changed as seen from two intermediate links to the left and four to the right between the adjacent stapling links 30L, 30, 30R, in order to provide staples spaced at desired distances in the paper product 24. The cam track 32 is configured to move rollers 31 up and down vertically to reciprocate a movable clip assembly guided internally in links 30, as will be described in detail hereinafter. Thus, a length of wire may be grasped, a staple formed, and the staple inserted into the paper product as the stapler links 30 travel continuously along cam track 32. In the lowermost row of links, and mating with the stapler links 30, are anvils 33 for clinching the staple as it is driven through the paper product 24. Intermediate upper and lower links 34, 35 simply mate in a triangular die seat, as seen in FIG. 2, for creasing the paper product 24 along the staple line at the apex of the triangle, as do links 30 and 33 also.

Figure 2:
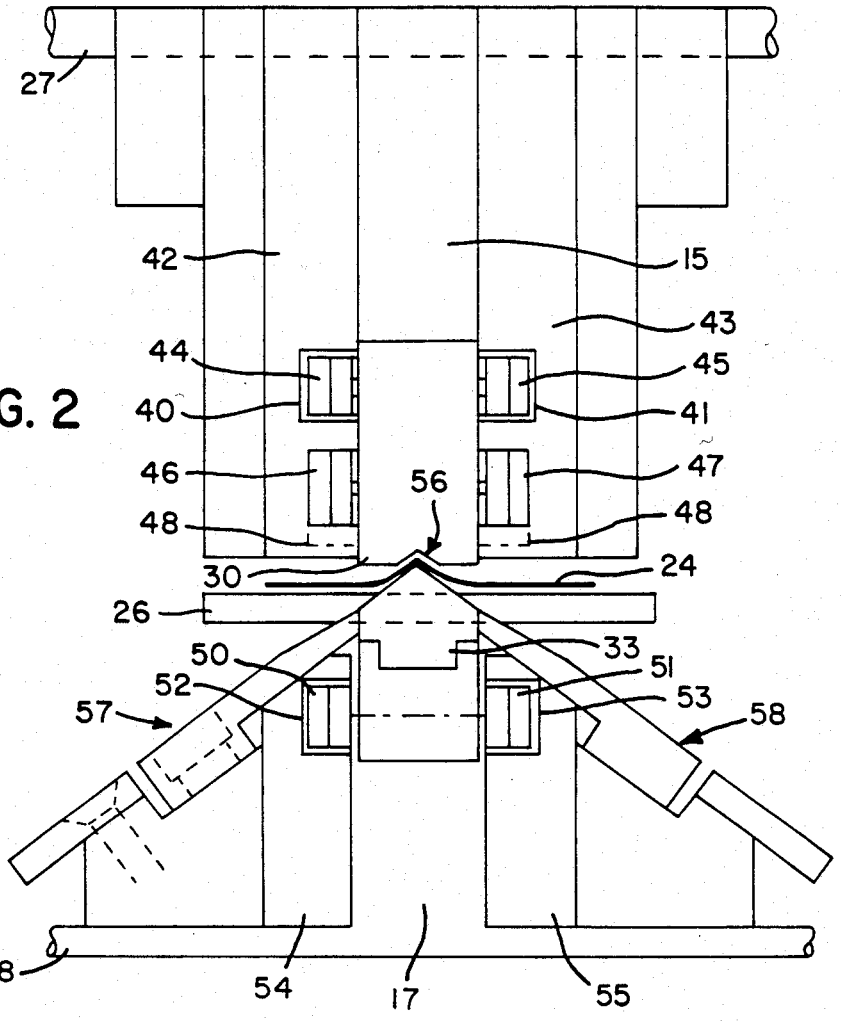
FIG. 2 is an end view simplified sketch taken along line 2—2 of FIG. 1 showing the respective mating stapler and clinching anvil links.

It may be seen from FIG. 2 that the chain sprockets 15 and 17 rotating about shafts 27, 28 carry the chain links 34, 35 respectively toward the viewer. The links are shown in their vertical positions, as guided by the cam tracks and rollers, just before meeting contiguously so that the paper product 24 may be inserted and grasped between links 30 and 33 until discharged at the exit end of the transit path between the two chains.

The cam tracks 40 and 41 in frame members 42, 43 respectively accept the rollers 44, 45 of the links on the upper chain, and thus position the stapler links 30. The cam rollers for operating the stapler mechanism ride in separate cam tracks 46, 47, and the vertical relative range of movement thus afforded the internally disposed, reciprocating clip mechanism is indicated by the dotted lines 48. Similarly, the links on the lower chain have rollers 50, 51 cammed in tracks 52, 53 in the framework assembly panels 54, 55.

In order to process the paper articles creased for aligned by the triangular shaped die set 56, the tented skirt arrangement 57, 58 is provided along the transit path of the paper products between the chains. Thus the exit path from this stapling and creasing apparatus provides for the handling of the creased and stapled paper products by means of rollers and conveyors, not shown.

Figure 3:
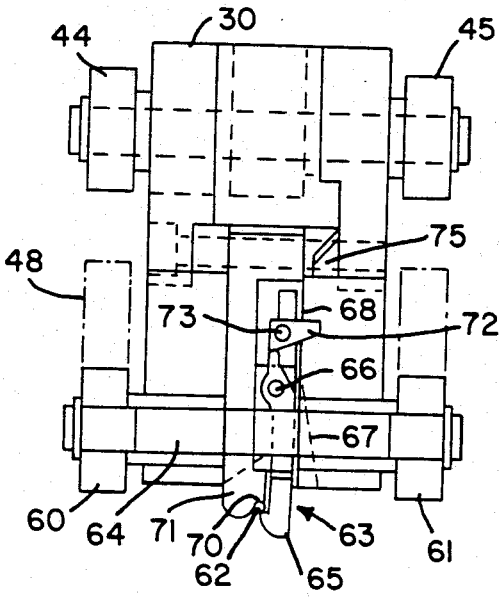
FIGS. 3 and 4 are respective front and rear end views of the staple forming link with the reciprocating clip mechanism respectively in extended and retracted positions.
Figure 4:
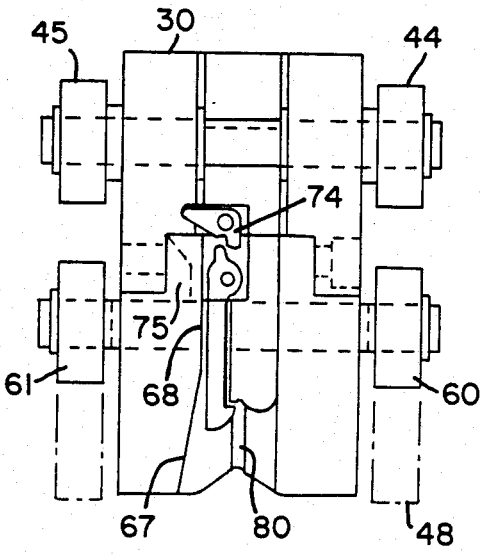

Reciprocation of the internally guided clip mechanism in the stapler links 30 is illustrated in FIGS. 3 and 4. The cam arms extending from the reciprocating, internally guided wire handling clip mechanism have rollers 60, 61 which are vertically reciprocated by riding in the cam tracks 46, 47 hereinbefore mentioned. Note that these stapler links 30 are in the upper track so that a staple wire 62 released from the clip mechanism 63 can drop free when not inserted into a paper product, and thereby avoids jamming when another wire is inserted.

The wire handling reciprocating clip assembly is vertically moved by shaft 64 in response to the cam track configuration. As seen in FIG. 3 therefore, the clip mechanism 63 is extended from the link body 30 to hold a wire or staple 62. The clip mechanism thus has a clip arm 65 pivoted about pin 66 to move against inclined wall 67 only when clip arm 65 is extended out of the journalled and confining internal wall 68 of the stapler link 30. Clip arm 65 is spring biased to close the clip arm over the wire 62 and hold it locked in place in the matrix groove 70 of the reciprocating body member 71 in which the pivot pin 66 is carried.

This construction permits the entry of a straight piece of wire cut from a roll, from which a staple is to be formed, by simply pushing aside the cip 65 by the wire and pushing it into matrix groove 70.

The clip mechanism also has a single way acting toggle 72 pivoted on pin 73 carried in reciprocating body member 71, for the purpose of pivoting and opening the clip arm 65 only in the direction with the body 71 moving outwardly from the journal cavity within stapler link 30. The toggle 72 is biased by tension spring 74 against a stop (not shown) to rest in the position shown. Cam surface 75 is provided for operating the toggle 72.

Thus, as the clip mechanism moves inwardly the toggle 72 simply rotates (clockwise as seen in FIG. 3) without engaging and pivoting clip arm 65 when it strikes the bottom edge of cam 75. However, when the reciprocating clip mechanism comes downward, as it moves outwardly the toggle 72 strikes the slanted upper cam surface 75, and rotates to engage the inner end of the pivotable clip arm 65, thereby opening the clip mechanism and permitting the wire 62 to be released by falling out or being carried along with a paper product into which a staple penetrates.

The cam tracks 46, 47 (FIG. 2) will guide rollers 60, 61 to perform several modes of operation with the grasping and release of wire lengths and staples, such as wherein the toggle 72 and cam 75 can hold the clip arm 63 open when it resides flush with the bottom of the stapler link 30. The wire clip assembly is extended as in FIG. 3 to receive wire lengths cut from a roll from which staples are formed. The clip arm then is moved inside the internal cavity to form a U-shaped staple by carrying the wire between the reciprocating assembly and die grooves 80 by bending the wire on either side of the cavity walls. It is pushed out into the opposing, anvil clinching link 33, firmly held in place by the roller-cam arrangement, as the paper product and links travel together along the common transit and creasing path formed by the two chains contiguously meeting. Preferably, the cam track 46 retracts the clip mechanism at least slightly immediately after the staple is clinched in order to prevent denting or deforming the paper product by the clip arm as it continues in the transit path.

Figure 4A:
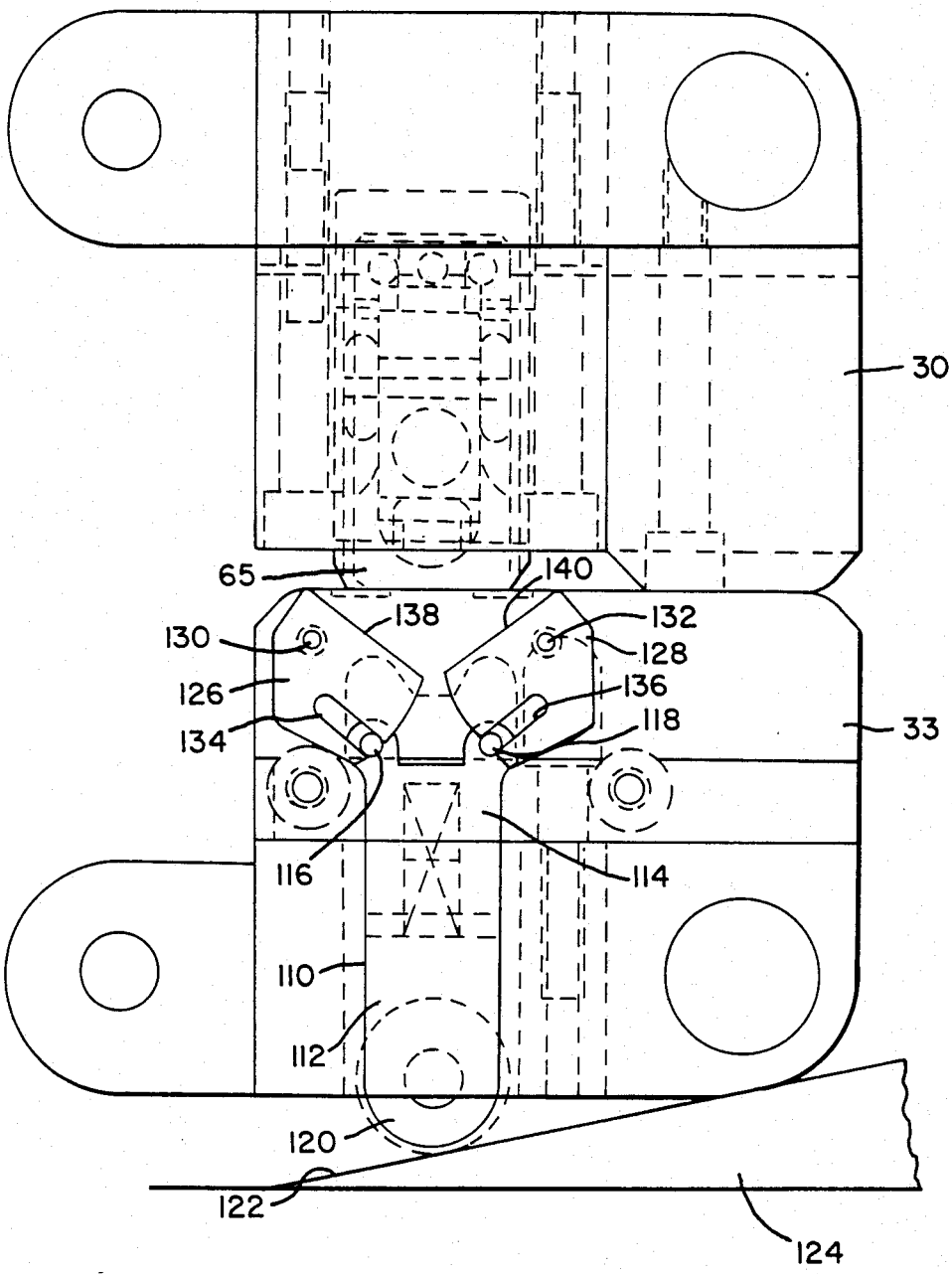
FIG. 4A is a side view showing a stapler link and an adjacent anvil link before a staple is clinched.

Referring now to FIG. 4A, an avil link 33 is shown adjacent to stapler link 30, in the position immediately before the staple is clinched. A guide passageway 110 is in opposed and aligned relationship with clip arm 65, and slidably receives a push rod 112 that includes an upper end 118. The opposite end of push rod 112 carries a cam follower in the form of a cam roller 120 that is movable along the surface 122 of cam 124 to raise push rod 112 in passageway 110.

Anvil link 33 carries a pair of spaced, opposed clinch plates 126, 128, which are pivotable about pins 130, 132, respectively. Clinch plates 126, 128 each include opposed open slots 134, 136, respectively that slidably receive guide pins 116 and 118, and also include respective clinch surfaces 138, 140. Upward movement of push rod 112 as a result of contact with cam surface 122 by cam roller 120 causes guide pins 116 and 118 to pivot clinch plates 126 and 128 inwardly and upwardly toward stapler link 30 to cause clinch surfaces 138 and 140 to bend the ends of the staple inwardly and thereby secure the staple in the signature.

Only two chains are required by this invention since the stapler link 30 itself serves to receive the wire, form it into a staple, eject the staple into the paper product and clinch it against the opposing anvil link 33. This is effected by the movable wire handling mechanism movable within the stapler link 30 internal cavity and guided by an extending cam arm to operate in its various modes. Thus, when links are connected into the two-chain assembly and operated by cam tracks along a contiguous paper product transit path, stapling (and creasing) is achieved during high speed transit of printed paper articles up to about 45,000 items per hour.

Figure 8:
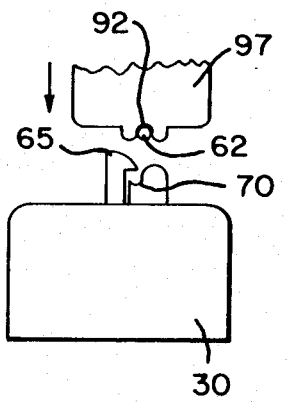
FIG. 8 is a sketch of the wire forming and transfer mechanism loading the stapler link looking into the path of the chain.
Figure 9:
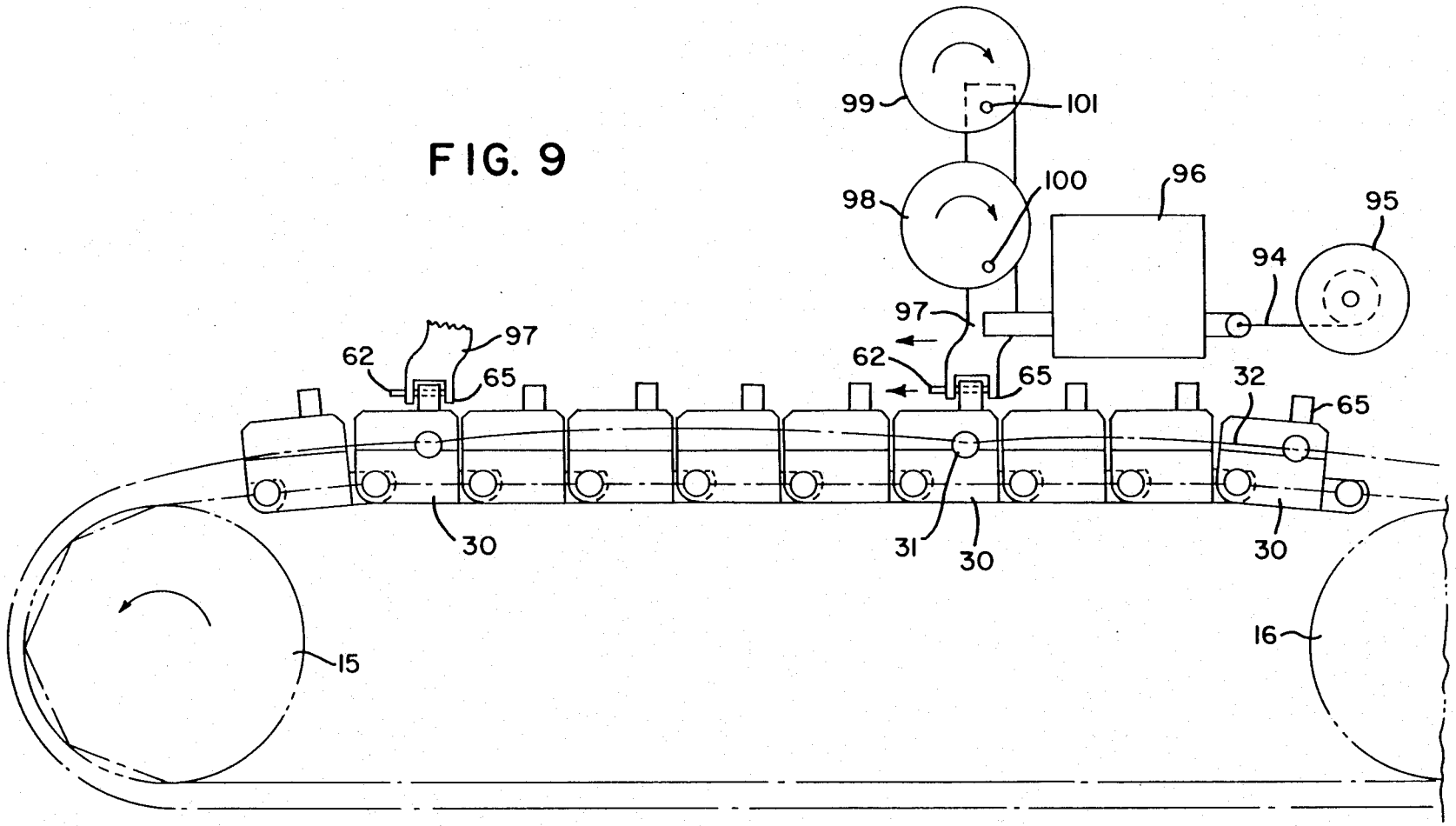
FIG. 9 is an assembly sketch in profile of the staple wire loading and transfer system.

For cutting lengths of wire from a roll and transferring them to the stapler link 30 clip mechanism, the structure shown in FIGS. 5 to 9 may be used. Thus, wire is pulled from a roll through guide path 81 and measured out in a length filling the gap between exit aperture 82 and stop arm 83 by means of the roller wheels 84, 85. Wheels 86, 87 serve to meter out individual lengths for filling the gap as provided by the cog surface 88 of wheel 86. Latch toggle 89 is shown as a stop which can be used to program and feed lengths of wire in synchronism with a stapler, etc. as actuating by a moving cam on a mechanism removing a piece of wire from the gap. The toggle 89 simply engages the cog surface 88 and prevents the wheel 86 from turning to dispense another wire length. Although shown in FIG. 5 as undergoing a change in direction, if desired guide path 81 can be a straight line, as shown in FIG. 9.

Figure 5:
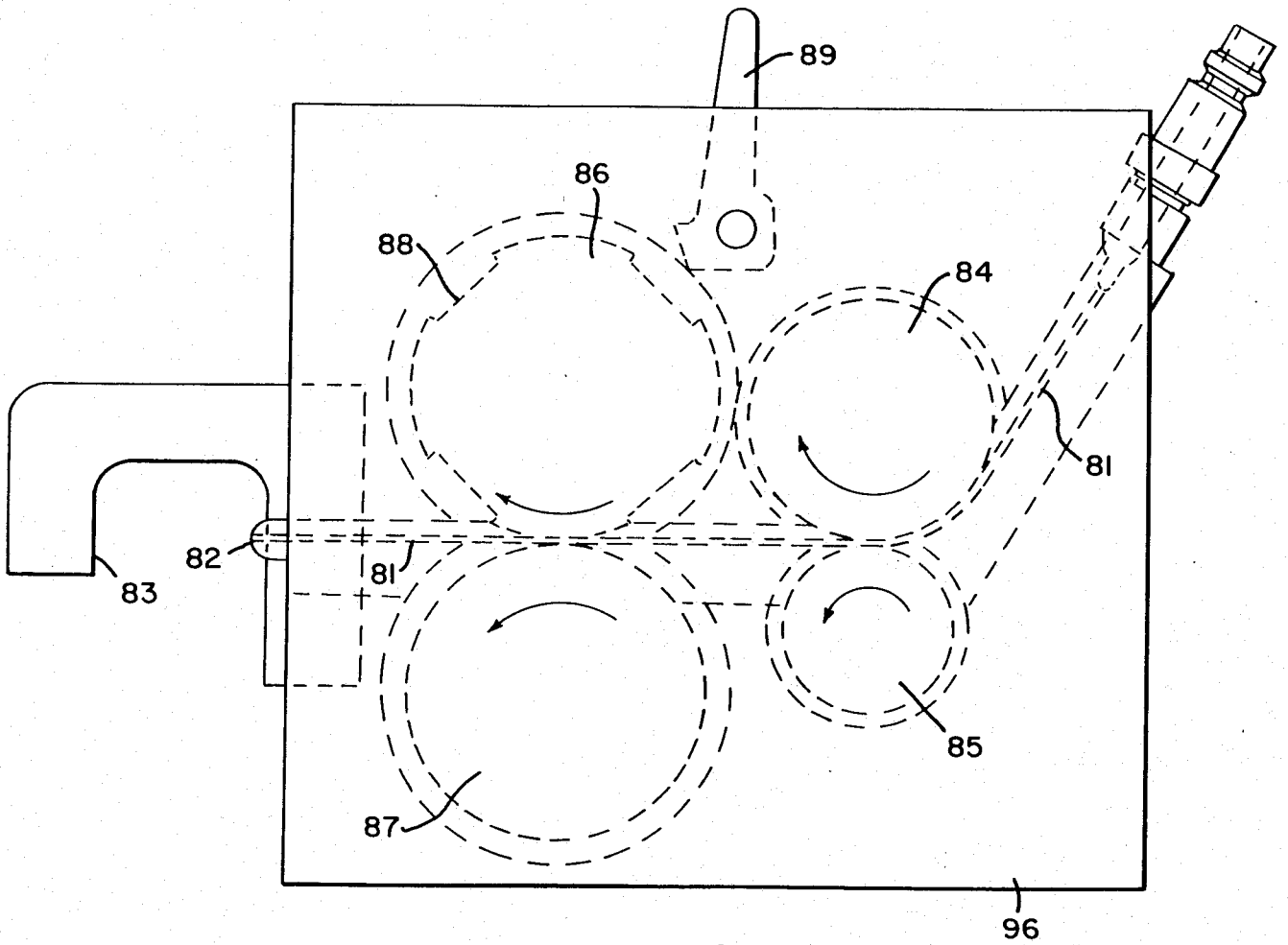
FIG. 5 is a side view sketch of a mechanism for metering out lengths of wire from a wire roll.
Figure 6:
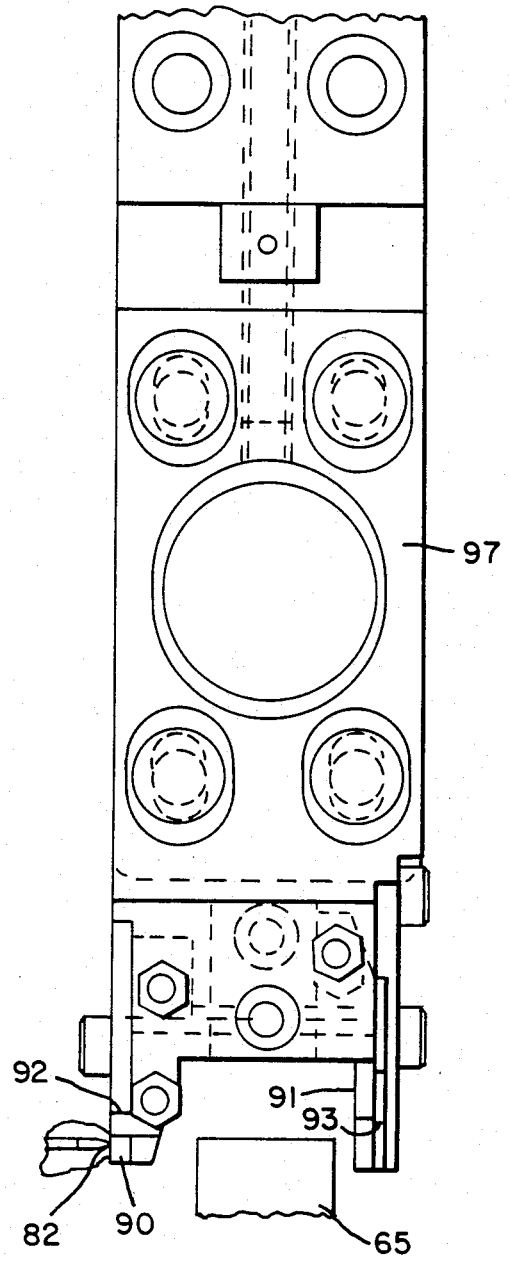
FIG. 6 is a side view of a wire cutting and transfer assembly that cuts off a piece of wire from the FIG. 5 mechanism and transports it to the moving chain stapler links.
Figure 7:
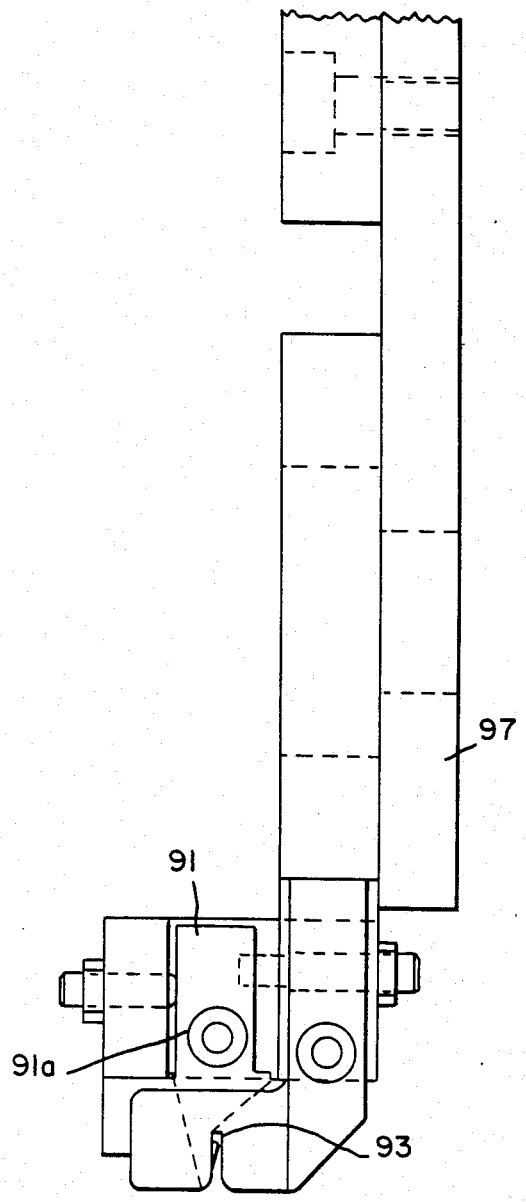
FIG. 7 is a right side view of the assembly of FIG. 6.

FIGS. 6 and 7 illustrate a wire cutting and transfer mechanism which is moved into the gap of FIG. 5. Thus, a knife 90 cuts off the wire adjacent aperture 82, and spring biased, pivotable pawl 91, which is pivotable about rod 91*a*, seats the wire into grooves 92, 93 for transport. As seen in FIG. 6, the wire held in pawl 91 and grooves 92, 93 is then moved out of the gap (FIG. 5) and adjacent the clip arm 65, hereinbefore described, which holds the wire in stapler link 30 for processing into a staple and inserting into the paper product.

In FIG. 8, looking into the stapler link 30 along its travel path, the wire retention arm 97 is seen in its downward path approaching the clip arm 65, exposing wire receiving groove 70 when the pivotable clip arm 65 is forced apart by entry of wire 62. This action is seen in side view in FIG. 9.

FIG. 9 schematically shows the system interaction with wire 94 rolled off spool 95 through wire metering device 96 (FIG. 5) where a measured length is cut, removed from the metering device 96 and transported in retention arm 97 (FIGS. 6 and 7). The wheels 98, 99, which carry drive pins 100, 101, respectively, thus are rotated by drive means (not shown) to cycle a wire length into place on the chain between drive wheels 15, 16 to register with respective stapler links 30.

By means of movement of wheels 98, 99 the wire length 62 is thus moved downwardly and laterally adjacent the chain at the moment of contact and at the same time speed so that the wire 62 will move pivotable clip arm 65 aside, arm 97 will insert wire 62 into groove 70, and clip arm 65 will pivot for locking the wire into place and pulling it from the clasp 91 in arm 97. The clip mechanism 63 is stapler link 30 is guided to extend the wire retaining clip assembly as hereinbefore explained by means of cam pin 31 and cam track 32.

In order to provide flexibility of staple wire insertion positions, and also for reliability of the wire cutter-transfer assembly to thereby run at lower speeds and provide two wire feeds, two or more tandem wire cutter transfer assemblies 97 are located along the chain link path to independently cut and insert staple wires. These may be phased to space staples a given number of chain links apart to provide staples where desired in a given paper product. Thus, three cutter assemblies could space three staples for a single signature product, and two cutter assemblies could supply appropriate spacing for a two staple signature product.

It is therefore evident that this invention advances the state of the art, and those novel features believed descriptive of the nature and spirit of the invention are defined with particularity in the claims.

I claim:

1. In apparatus for stapling paper articles while the articles are moving along a common transit path, improved staple forming and inserting means comprising in combination, a stapler link carried by and cyclically movable relative to a chain assembly that travels repetitively about a continuous closed path including said transit path, said stapler link including a movable wire handling mechanism movable by a cam arm extending from the link, said wire handling mechanism having clip means for receiving and retaining a length of wire, and a die for forming a staple from the wire, said apparatus including first cam surface means engageable with the cam arm for drawing the clip means into the die to bend the wire and form a staple, and second cam surface means engageable with the cam arm for pushing said staple from said stapler link into the paper articles.

2. The stapler link as defined in claim 1, wherein the first and second cam surface means are disposed along the continuous path for engaging said cam arm and operating said wire handling mechanism in a cyclic sequence as it moves about the continuous path to perform the functions of grasping a wire by means of said clip at a predetermined wire receiving station along the continuous path, for pulling the wire into the die to form a staple, for pushing the staple out of the die into a paper article moving along said transit path as the stapler link and the paper articles move at the same speed along the common transit path, and for opening the clip to release the staple, thereby to transfer it to said paper articles.

3. The stapler link as defined in claim 2, wherein the first and second cam surface means are defined by a continuous cam track.

4. The stapler link as defined in claim 12, wherein the cam track additionally opens]1, including third cam surface means cooperably engageable with the clip means to open the clip means to release the staple whenever a paper article is not in place to receive the staple.

5. The stapler link as defined in claim 4, wherein the first, second, and third cam surface means are defined by a continuous cam track positioned adjacent the path of travel of the chain assembly.

6. The stapler link as defined in claim 1, wherein the second cam surface means additionally retracts the link away from the common transit path after the staple is passed through the paper article.

7. The stapler link defined in claim 1 coupled in a first chain assembly movable cyclically about a path including said transit path to mate along said transit path with a second chain assembly comprising stapling anvil links mating with the stapling links along said transit path to form grasping means for receiving and moving said paper articles along said transit path.

8. The stapler link as defined in claim 7, wherein the mating stapling and anvil links included creasing means to increase said paper products as they move along said transit path.

9. The stapler link defined in claim 1 wherein said wire handling mechanism comprises a reciprocating assembly movable internally in a journal cavity within said link, and said die is formed in the cavity walls.

10. The stapler link defined in claim 9 wherein the wire clip comprises a spring biased pivotable clip arm, for locking the wire in place against a matrix receptacle for holding the wire, having a cam surface movable by engagement with said length of wire to pivot the clip arm to move aside while inserting the wire in the matrix position and permitting the spring biased clip arm to pivot back into a position locking the wire in place.

11. The stapler link defined in claim 9 wherein the pivotable clip arm is provided with a spring baised toggle which in one direction of movement pivots the clip arm to open the clip and in the other direction of movement slips the clip arm without moving the clip from the closed position, and wherein said cavity includes a cam member for slipping the toggle arm when the wire length is drawn into the cavity to form the staple and for pivoting the clip arm by operating the toggle when the staple is removed from the die by reciprocation of the wire handling mechanism outwardly from the cavity thereby to release the staple from the clip.

12. The stapler link defined in claim 1 connected in a stapling assembly constituting only two link chains commonly movable along said transit path, wherein the stapler link serves to receive the length of wire, form it into a staple and eject it by means of said wire handling mechanism thereof.

13. The stapling assembly defined by claim 12 including means for cutting a length of wire, and moving the wire alongside the cyclic path of movement of the stapling link for inserting it into said clip.

14. The stapling assembly defined by claim 13 wherein the clip comprises a pivoted retainer member overlying a fixed matrix receptacle for receiving a length of wire substantially at its center, and the means inserting the wire into said clip engages said pivoted retainer member to pivot it, insert the wire and release it to retain the wire in the receptacle.

15. The stapling assembly defined by claim 1 including two chains each with a plurality of links connected in a chain, the links in one chain comprising stapler links and the links in the other chain comprising clinching links wherein each link is supplied with a pair of opposed rollers, and cam track means for engaging the rollers and for moving each link through a cyclic pattern past said transit path, said cam track means being position to force said links of the two chains together to grasp and transport the paper articles.

16. The stapling assembly defined by claim 1 including a plurality of links formed into a chain, each link having a cam extending therefrom and cam track means engaging said cams to guide the chain around a define transit path.

17. Stapling apparatus comprising:

a. continuously moving staple forming and carrying means for forming U-shaped staples from individual cut wire lengths and for presenting the staples to moving signatures carried in a transit path to be stapled, and for inserting the staples into the moving signatures, said staple forming and carrying means including a plurality of stapler links supported on a movable stapler link carrier, said stapler links carried by and cyclically movable relative to a chain assembly that travels repetitively about a continuous closed path including said transit path, said stapler link including a movable wire handling mechanism movable by a cam arm extending from the link, said wire handling mechanism having clip means for receiving and retaining a length of wire, and a die for forming a staple from the wire, said apparatus including first cam surface means engageable with the cam arm for drawing the clip means into the die to bend the wire and form a staple, and second cam surface means engageable with the cam arm for pushing said staple from said stapler link into the paper articles;

b. continuously moving staple clinching means cooperable with the moving staple forming means for clinching the staples after they have been inserted into the moving signatures and while the signatures are moving along the transit path, said staple clinching means including a plurality of anvil links supported on a movable link carrier for cooperation with respective stapler links, said anvil links including a pair of opposed, pivotable clinch plates for engaging and bending respective legs of a U-sahepd staple to clinch a staple in position on a signature; and c. actuation means for pivoting said clinch plates.

18. Stapling apparatus in accordance with claim 17, wherein said actuation means include push rod means, slidably carried in said anvil links and engageable with said clinch plates for pivoting said clinch plates about respective clinch plate pivot axes.

19. Stapling apparatus in accordance with claim 18, wherein said actuation means includes cam track means for defining a cam surface and said push rod means includes cam follower means engageable with said cam surface for causing said push rod means to move a desired distance at a desired time to clinch a staple.

20. Stapling apparatus in accordance with claim 19, wherein said clinch plates each include a slot for engagement by said push rod means, and said push rod means carries pins engageable with respective slots to simultaneously pivot a pair of clinch plates to clinch respective legs of a U-shaped staple.

21. Stapling apparatus in accordance with claim 17, wherein said apparatus further includes wire cutting and transfer means for cutting wire into predetermined cut wire lengths and for transferring cut wire lengths to said staple forming and carrying means.

22. Stapling apparatus in accordance with claim 21, wherein said apparatus further includes a plurality of wire cutting and transfer means positioned adjacent said staple forming and carrying means for providing a plurality of cut wire lengths to respective stapler links.

23. Stapling apparatus comprising:

a. continuously moving staple carrying means for carrying U-shaped staples and for presenting the staples to moving signatures carried in a transit path to be stapled, and for inserting the staples into the moving signature, said staples carrying means including a plurality of stapler links supported on a movable stapler link carrier, said stapler links carried by and cyclically movable relative to a chain assembly that travels repetitively about a continuous closed path including said transit path, said stapler link including a movable wire handling mechanism movable by a cam arm extending from the link, said wire handling mechanism having clip means for receiving and retaining a length of wire, and a die for forming a staple from the wire, said apparatus including first cam surface means engageable with the cam arm for drawing the clip means into the die to bend the wire and form a staple, and second cam surface means engageable with the cam arm for pushing said staple from said stapler link into the paper articles:

b. continuously staple clinching means cooperable with the moving staple carrying means for clinching the staples after they have been inserted into the moving signatures and while the signatures are moving along the transit path, said staple clinching means including a plurality of anvil links supported on a movable link carrier for cooperation with respective stapler links, said anvil links including a pair of opposed, pivotable clinch plates for engaging and bending respective legs of a U-shaped staple to clinch a staple in position on a signature; and c. actuation means for pivoting said clinch plates.

24. Stapling apparatus in accordance with claim 23, wherein said actuation means include push rod means, slidably carried in said anvil links and engageable with said clinch plates for pivoting said clinch plates about respective clinch plate pivot axes.

25. Stapling apparatus in accordance with claim 24, wherein said actuation means includes cam track means for defining a cam surface, and said push rod means includes cam follower means engageable with said cam surface for causing said push rod means to move a desired distance at a desired time to clinch a staple.

26. Stapling apparatus in accordance with claim 25, wherein said clinch plates each include a slot for engagement by said push rod means, and said push rod means carries pins engageable with respective slots to simultaneously pivot a pair of clinch plates to clinch respective legs of a U-shaped staple.

27. Stapling apparatus in accordance with claim 23, wherein said apparatus further includes wire cutting and transfer means for cutting wire into predetermined cut wire lengths and for transferring cut wire lengths to said staple carrying means.

28. Stapling apparatus in accordance with claim 27, wherein said apparatus further includes a plurality of wire cutting and transfer means positioned adjacent said staple carrying means for providing a plurality of cut wire lengths to respective stapler links.

29. Stapling apparatus in accordance wtih claim 27, including staple forming means carried by said staple carrying means for forming U-shaped staples from said cut wire lengths.

* * * * *

UNITED STATES PATENT AND TRADEMARK OFFICE

CERTIFICATE OF CORRECTION

PATENT NO. : 4,792,077

DATED : December 20, 1988

INVENTOR(S) : Hans G. Faltin

It is certified that error appears in the above-identified patent and that said Letters Patent is hereby corrected as shown below:

Column 7, lines 4 and 5, delete "12, wherein the cam track additionally opens]"
line 25, change "included" to -- include --.
line 26, change "increase" to -- crease --.

Column 8, line 11, change "position" to -- positioned --.
line 51, change "sahepd" to -- shaped --.

Column 9,
line 35, after "continuously" insert -- moving --.

Signed and Sealed this

Twenty-ninth Day of August, 1989

*Attest:*

DONALD J. QUIGG

*Attesting Officer*

*Commissioner of Patents and Trademarks*